US009322151B2

(12) United States Patent
Janakiraman et al.

(10) Patent No.: US 9,322,151 B2
(45) Date of Patent: Apr. 26, 2016

(54) SHOWER HEAD CONTROLLER

(71) Applicant: International Business Machines Corporation, Armonk, NY (US)

(72) Inventors: Janani Janakiraman, Austin, TX (US); Dany R Madden, Beaverton, OR (US); Meenakshi Sripal, Saint Louis, MO (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 420 days.

(21) Appl. No.: 13/660,826

(22) Filed: Oct. 25, 2012

(65) Prior Publication Data

US 2014/0115772 A1 May 1, 2014

(51) Int. Cl.

| | |
|---|---|
| ***E03C 1/04*** | (2006.01) |
| ***E03C 1/05*** | (2006.01) |
| *A47K 3/28* | (2006.01) |

(52) U.S. Cl.

CPC ..... *E03C 1/0408* (2013.01); *E03C 1/057* (2013.01); *A47K 3/281* (2013.01)

(58) Field of Classification Search

CPC ..... E03C 1/055; E03C 1/057; E03C 1/0408; A47K 3/281; B05B 1/18

USPC ..... 4/596, 597, 668, 605, 661

See application file for complete search history.

(56) References Cited

U.S. PATENT DOCUMENTS

| | | | | |
|---|---|---|---|---|
| 4,508,141 | A | 4/1985 | Tsipov | |
| 4,934,000 | A * | 6/1990 | Freedman | 4/597 |
| 5,838,233 | A * | 11/1998 | Hawes et al. | 340/572.5 |
| 6,016,836 | A * | 1/2000 | Brunkhardt | 137/624.11 |
| 6,250,601 | B1 * | 6/2001 | Kolar et al. | 251/129.04 |
| D462,915 | S * | 9/2002 | Bush | D10/121 |
| 6,925,661 | B1 * | 8/2005 | Anger | 4/559 |
| 6,956,498 | B1 * | 10/2005 | Gauthier et al. | 340/12.51 |
| 7,669,765 | B2 | 3/2010 | Harper et al. | |

(Continued)

FOREIGN PATENT DOCUMENTS

| | | | |
|---|---|---|---|
| CN | 201572017 | * | 9/2010 |
| CN | 201572017 U | | 9/2010 |

OTHER PUBLICATIONS

Evolve, Lower Flow Showerheads, http://evolveshowerheads.conn/lower_flo_showerheads.html, Last Retrieved: Aug. 22, 2012.

*Primary Examiner* — Tuan N Nguyen

*Assistant Examiner* — William R Klotz

(74) *Attorney, Agent, or Firm* — Kunzler Law Group; Steven L. Bennett

(57) ABSTRACT

An apparatus includes a sensor module, a transmission module, a flow reduction module, and a flow return module. The sensor module senses presence of a shower item on a shelf in a shower and senses a lack of presence of the shower item on the shelf. The transmission module wirelessly transmits an item missing signal. The item missing signal is transmitted in response to sensing a lack of presence of the shower item on the shelf. The flow reduction module reduces water flow to a shower head in the shower from a first flow level to a reduced flow level in response to wirelessly receiving the item missing signal. The flow return module returns water flow to the first flow level in response to expiration of a restore time delay or wirelessly receiving an item return signal in response to sensing a presence of the shower item on the shelf.

14 Claims, 6 Drawing Sheets

(56) References Cited

U.S. PATENT DOCUMENTS

| | | | | |
|---|---|---|---|---|
| 7,733,228 | B2 | 6/2010 | Lee et al. | |
| 7,920,062 | B1 | 4/2011 | Konstad et al. | |
| 8,893,320 | B2 * | 11/2014 | Klicpera | 4/615 |
| 2009/0261282 | A1 * | 10/2009 | Connors | 251/129.01 |
| 2010/0095451 | A1 * | 4/2010 | Quinn | 4/605 |
| 2010/0138988 | A1 * | 6/2010 | Holmes | 4/605 |
| 2010/0200789 | A1 | 8/2010 | Connors | |
| 2010/0264345 | A1 | 10/2010 | Tips | |
| 2011/0260827 | A1 | 10/2011 | Shapiro et al. | |
| 2011/0289675 | A1 * | 12/2011 | Dunki-Jacobs et al. | 4/668 |
| 2012/0017367 | A1 | 1/2012 | Reeder et al. | |

* cited by examiner

SHOWER HEAD CONTROLLER

BACKGROUND

1. Field

The subject matter disclosed herein relates to conserving water and more particularly relates to reducing water flow in a shower.

2. Description of the Related Art

Water is natural resource that should be conserved to reduce impact on lakes, streams, rivers, and culinary water supply. Many locations are facing a challenge of population growth where water supply is limited. From large factories to individuals, water usage at every level is being examined to find ways to reduce water consumption. One area of potential conservation includes water usage while showering.

BRIEF SUMMARY

An apparatus for water usage reduction is disclosed. One embodiment of an apparatus includes a sensor module, a transmission module, a flow reduction module, and a flow return module. The sensor module, in one embodiment, senses a presence of a shower item on a shelf in a shower and senses a lack of presence of the shower item on the shelf. The transmission module, in one embodiment, transmits an item missing signal. The item missing signal is transmitted in response to the sensor module sensing a lack of presence of the shower item on the shelf. The item missing signal is a wireless signal. The flow reduction module reduces water flow to a shower head in the shower from a first flow level to a reduced flow level in response to wirelessly receiving the item missing signal. The flow return module returns water flow to the first flow level in response to expiration of a restore time delay and/or wirelessly receiving an item return signal from the transmission module. The item return signal is in response to the sensor module sensing a presence of the shower item on the shelf.

In one embodiment, the apparatus includes a shower start module that determines that water is flowing through the shower head and/or movement is detected in the shower, and a sensor reset module that initiates sensing by the sensing module in response to the shower start module determining that water is flowing through the shower head or that movement is detected in the shower. In a further embodiment, the transmission module withholds sending the item missing signal until after the shower start module determines water flow or motion, the sensor reset module initiates sensing, and the sensor module senses the presence of the shower item on the shelf and then senses lack of the shower item on the shelf.

In one embodiment, the item missing signal includes a radio frequency identifier ("RFID") signal and/or a blue tooth signal. In another embodiment, the item return signal includes cessation of the item missing signal. In another embodiment, the sensor module, the transmission module, flow reduction and the flow return module are powered with a low voltage power source. For example, the low voltage source may be a battery.

In one embodiment, the flow reduction and the flow return module are integral with the shower head. In another embodiment, the sensor module and the transmission module integral with the shelf. In another embodiment, the sensor module senses the presence of the shower item by sensing a change in weight on the shelf. In another embodiment, the sensor module senses the presence of the shower item using an infrared sensor and/or an ultrasonic sensor focused on an area above the shelf.

In one embodiment, the apparatus includes a configuration module that, in response to user input, sets the restore time delay, configures the flow return module to return water flow to the first level after the restore time delay, configures the flow return module to return water flow to the first level after receiving the item return signal, and/or configures the flow return module to return water flow to the first level after receiving the item return signal and after the restore time delay. In another embodiment, the sensor module and the transmission module are integral with the shelf. In another embodiment, the flow reduction module and the flow return module are integral with the shower head.

A system for reducing water flow includes a shelf apparatus and a shower head apparatus. The shelf apparatus is configured to mount with a shelf in a shower. The shelf apparatus, in one embodiment, includes a sensor module that senses a presence of a shower item on the shelf in a shower and senses a lack of presence of the shower item on the shelf and a transmission module that transmits an item missing signal. The item missing signal is transmitted in response to the sensor module sensing a lack of presence of the shower item on the shelf. The item missing signal includes a wireless signal.

The shower head apparatus is configured to mount with a shower head in the shower. The shower head apparatus may be integral with the shower head, mounted at the shower head, or mounted near the shower head. The shower head apparatus includes a flow reduction module that reduces water flow to the shower head from a first flow level to a reduced flow level in response to wirelessly receiving the item missing signal. The shower head apparatus includes a flow return module that returns water flow to the first flow level in response to expiration of a restore time delay and/or of wirelessly receiving an item return signal from the transmission module. The item return signal is in response to the sensor module sensing a presence of the shower item on the shelf.

In one embodiment, the shower head apparatus is integral to the shower head. In another embodiment, the shower head apparatus is connected to the shower head. In another embodiment, the system includes a shower start module that determines that water is flowing through the shower head and/or movement is detected in the shower, and a sensor reset module that initiates sensing by the sensing module in response to the shower start module determining that water is flowing through the shower head and/or movement is detected in the shower. In another embodiment, the transmission module withholds sending the item missing signal until after the shower start module determines that water is flowing through the shower head or movement is detected in the shower, the sensor reset module initiates sensing, and the sensor module senses the presence of the shower item on the shelf and then senses lack of the shower item on the shelf.

Another apparatus includes a sensor module, a transmission module, a flow reduction module, a flow return module, a shower start module, and a sensor reset module. The sensor module senses a presence of a shower item on a shelf in a shower and senses a lack of presence of the shower item on the shelf. The transmission module transmits an item missing signal. The item missing signal is transmitted in response to the sensor module sensing a lack of presence of the shower item on the shelf and the item missing signal includes a RFID signal or a blue tooth signal. The flow reduction module reduces water flow to a shower head in the shower from a first flow level to a reduced flow level in response to wirelessly receiving the item missing signal.

The flow return module returns water flow to the first flow level in response to expiration of a restore time delay and/or wirelessly receiving an item return signal from the transmission module. The item return signal is in response to the sensor module sensing a presence of the shower item on the shelf. The shower start module determines that water is flowing through the shower head and the sensor reset module initiates sensing by the sensing module in response to the shower start module determining that water is flowing through the shower head. Modules at the shelf location and modules at the shower head location communicate wirelessly without wires between the shelf location and the shower head location.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION OF THE INVENTION

Figure 1:
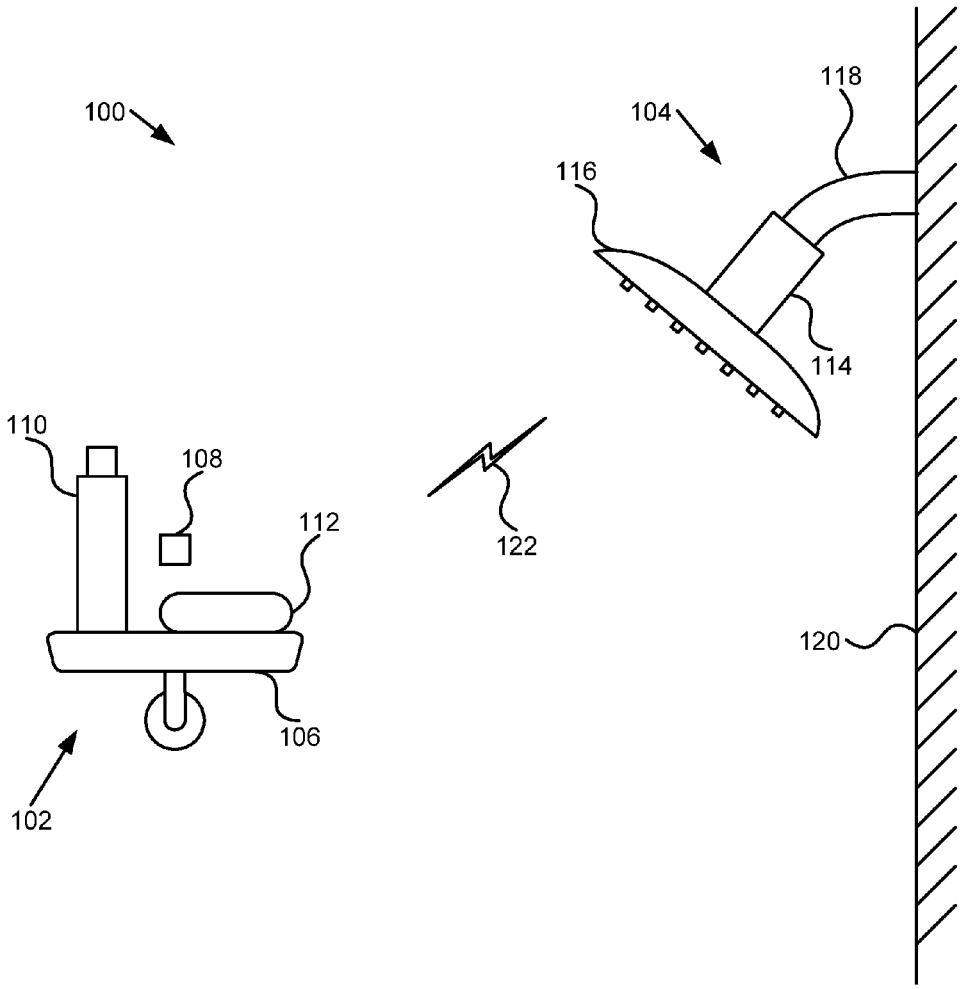
FIG. 1 is a schematic block diagram illustrating one embodiment of a system for reducing water flow in accordance with the present invention.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

These features and advantages of the embodiments will become more fully apparent from the following description and appended claims, or may be learned by the practice of embodiments as set forth hereinafter. As will be appreciated by one skilled in the art, aspects of the present invention may be embodied as a system, method, and/or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module," or "system."Furthermore, aspects of the present invention may take the form of a computer program product embodied in one or more computer readable medium(s) having computer readable program code embodied thereon.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of computer readable program code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of computer readable program code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the computer readable program code may be stored and/or propagated on in one or more computer readable medium(s).

The computer readable medium may be a tangible computer readable storage medium storing the computer readable program code. The computer readable storage medium may be, for example, but not limited to, an electronic, magnetic, optical, electromagnetic, infrared, holographic, micromechanical, or semiconductor system, apparatus, or device, or any suitable combination of the foregoing.

More specific examples of the computer readable storage medium may include but are not limited to a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), an optical storage device, a magnetic storage device, a holographic storage medium, a micromechanical storage device, or any suitable combination of the foregoing. In the context of this document, a computer readable storage medium may be any tangible medium that can contain, and/or store computer readable program code for use by and/or in connection with an instruction execution system, apparatus, or device.

The computer readable medium may also be a computer readable signal medium. A computer readable signal medium may include a propagated data signal with computer readable program code embodied therein, for example, in baseband or as part of a carrier wave. Such a propagated signal may take any of a variety of forms, including, but not limited to, electrical, electro-magnetic, magnetic, optical, or any suitable combination thereof. A computer readable signal medium may be any computer readable medium that is not a computer readable storage medium and that can communicate, propagate, or transport computer readable program code for use by or in connection with an instruction execution system, apparatus, or device. Computer readable program code embodied on a computer readable signal medium may be transmitted using any appropriate medium, including but not limited to wireline, optical fiber, Radio Frequency (RF), or the like, or any suitable combination of the foregoing.

In one embodiment, the computer readable medium may comprise a combination of one or more computer readable storage mediums and one or more computer readable signal mediums. For example, computer readable program code may be both propagated as an electro-magnetic signal through a fiber optic cable for execution by a processor and stored on RAM storage device for execution by the processor.

Furthermore, the described features, structures, or characteristics of the embodiments may be combined in any suitable manner. In the following description, numerous specific details are provided, such as examples of programming, software modules, user selections, network transactions, hardware modules, hardware circuits, hardware chips, etc., to provide a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

Aspects of the embodiments are described below with reference to schematic flowchart diagrams and/or schematic block diagrams of methods, apparatuses, systems, and computer program products according to embodiments of the invention. It will be understood that each block of the schematic flowchart diagrams and/or schematic block diagrams, and combinations of blocks in the schematic flowchart diagrams and/or schematic block diagrams, can be implemented by computer readable program code. The computer readable program code may be provided to a processor of a general purpose computer, special purpose computer, sequencer, or other programmable data processing apparatus to produce a machine, such that the instructions, which execute via the processor of the computer or other programmable data processing apparatus, create means for implementing the functions/acts specified in the schematic flowchart diagrams and/or schematic block diagrams block or blocks.

The computer readable program code may also be stored in a computer readable medium that can direct a computer, other programmable data processing apparatus, or other devices to function in a particular manner, such that the instructions stored in the computer readable medium produce an article of manufacture including instructions which implement the function/act specified in the schematic flowchart diagrams and/or schematic block diagrams block or blocks.

The schematic flowchart diagrams and/or schematic block diagrams in the FIGS. illustrate the architecture, functionality, and operation of possible implementations of apparatuses, systems, methods and computer program products according to various embodiments of the present invention. In this regard, each block in the schematic flowchart diagrams and/or schematic block diagrams may represent a module, segment, or portion of code, which comprises one or more executable instructions of the program code for implementing the specified logical function(s).

It should also be noted that, in some alternative implementations, the functions noted in the block may occur out of the order noted in the FIGS. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated FIGS.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and computer readable program code.

FIG. 1 is a schematic block diagram illustrating one embodiment of a system 100 for reducing water flow in accordance with the present invention. The system 100 may include a shelf apparatus 102 and a shower head apparatus 104. The shelf apparatus may include a shelf 106, a sensor 108, and shower items such as shampoo 110 and soap 112. The shower head apparatus 104 may include a flow control module 114 and a shower head 116 which may be connected to a pipe 118 extending from a wall 120. The shower head apparatus 104 and shelf apparatus 102 may communicate wirelessly 122. The elements 102-122 of the system 100 are described below.

In one embodiment the system 100 includes a shelf apparatus 102, a shelf 106 and sensor 108. The shelf apparatus 102, in one embodiment, includes a sensor module 202 and a transmission module 204, which are described below with respect to the apparatus 200 of FIG. 2. The shelf apparatus 102 may include the shelf 106 and may include the sensor 108. In one embodiment, the shelf 106 is mounted on a wall 120 of a shower. In another embodiment, the shelf 106 is constructed within the shower, for example by creating a notch or recess in the shower construction. One of skill in the art will recognize other forms for shower shelves 106. The shelf 106 may have shower items situated on the shelf 106. For example, shampoo 110, conditioner (not shown), soap 112, body wash (not shown) or other shower item may be placed on the shelf 106. The sensor 108 is situated and configured to determine if a shower item is removed and/or replaced on the shelf 106.

The system 100 includes a shower head apparatus 104, a flow control module 114 and a shower head 116. In one embodiment, the shower head apparatus 104 includes the shower head 116. The flow control module 114 is typically connected to a pipe 118 that extends into a wall 120. In another embodiment, a pipe 118 connects to the shower head 116 and the flow control module 114 is connected to the shower head 116 or pipe 118 or is mounted to the wall 120. In other embodiments, the shower head 116 is connected to a pipe 118 extending from the ceiling of the shower. In another embodiment, the shower head 116 is flush with the wall 120 or connected close to the wall 120. One of skill in the art will recognize other forms of a shower head 116 in a shower. The flow control module 114 controls flow in the shower head 116. The shelf apparatus 102 and the shower head apparatus 104 communicate wirelessly 122. In one embodiment, the flow control module 114 include a flow reduction module 206 and a flow return module 208, which are described below with respect to the apparatus 200 of FIG. 2.

Figure 2:
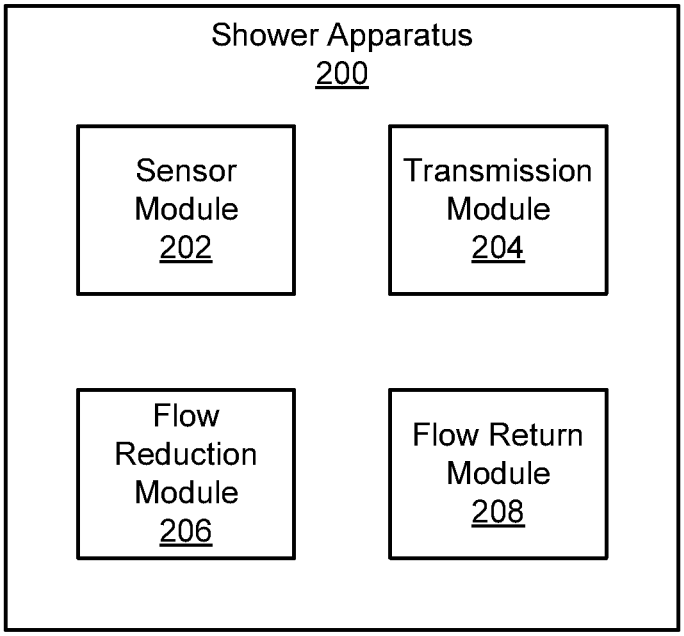
FIG. 2 is a schematic block diagram illustrating one embodiment of an apparatus for reducing water flow in accordance with the present invention.

FIG. 2 is a schematic block diagram illustrating one embodiment of a shower apparatus 200 for reducing water flow in accordance with the present invention. The shower apparatus 200 includes a sensor module 202, a transmission module 204, a flow reduction module 206, and a flow return module 208, which are described below.

In one embodiment, the shower apparatus 200 includes a sensor module 202 that senses a presence of a shower item (e.g. 110, 112) on a shelf 106 in a shower and senses a lack of presence of the shower item on the shelf 106. For example, if a shower item is shampoo 110 and the shampoo 110 is sitting on the shelf 106 in the shower, the sensor module 202 senses when the shampoo 110 is present on the shelf 106 and when the shampoo 110 has been removed from the shelf 106.

The sensor module 202, in one embodiment, includes a sensor 108. The sensor 108, in one embodiment, is a weight sensor integrated with or mounted on the shelf 106 and detects a change in weight when a shower item, for example shampoo 110 or soap 112, is removed from the shelf 106. In one embodiment, the sensor module 202 determines a difference in weight. For example, if soap 112 and shampoo 110 are sitting on the shelf 106, the sensor module 202 may sense when one or both of the shampoo 110 and soap 112 are removed by determining a difference in weight. By determining a difference in weight, the sensor module 202 may sense that one shower item has been removed while one or more additional shower items remain on the shelf 106. The sensor module 202 may determine that the shower item is returned by detecting an increase in weight. In one embodiment, the sensor module 202 accounts for shampoo 110, conditioner, soap 112, etc. used by a person showering so that the sensor module 202 determines presence of a returned shower item even though the shower item weighs less than when the shower item was removed.

In another embodiment, the sensor 108 detects that an item that was present is moved by determining a difference between received waves that were previously transmitted. For example, the sensor 108 may send and/or receive waveforms and the sensor module 202 with the sensor 108 may transmit a waveform and may receive and analyze reflected waveforms. The reflected waveforms may be a certain pattern or signature. When a shower item is removed, the sensor module 202 may detect a difference in the reflected waveform consistent with the shower item being removed and may signal that the shower item is removed. When the shower item is returned to the shelf 106, the sensor module 202 may also detect reflected waveforms consistent with the return of the shower item and may signal return of the shower item. The sensor 108 may use infrared waveforms, ultrasonic waveforms, light, or other waveforms that may detect presence or lack of presence of a shower item.

In one embodiment, the shower apparatus 200 includes a transmission module 204 that transmits an item missing signal. In one embodiment, the item missing signal is transmitted in response to the sensor module 202 sensing a lack of presence of the shower item on the shelf 106. The item missing signal is a wireless signal. For example, if the sensor module 202 detects that a shower item, such as soap 112 or shampoo 110, is removed from the shelf 106, the transmission module 204 transmits the item missing signal. The item missing signal, in one embodiment, is a general waveform. For example, the transmission module 204 may transmit a specific frequency. The item missing signal may be transmitting a specific frequency where when frequency is not transmitted the item missing signal is not sent. In another embodiment, not transmitting the frequency comprises an item return signal, which will be discussed further with respect to the flow return module 208.

In another example, the transmission module 204 transmits a pattern. For example, the transmission module 204 may transmit a message within a carrier frequency. In another embodiment, the transmission module 204 transmits a specific coded message, such as a digital message. In another example, ceasing to transmit the pattern or message comprises an item return signal. The transmission module 204 may send a pattern or message continuously while the sensor module 202 detects that a shower item is missing from the shelf 106, or may send a single message or pattern. The transmission module 204, in some embodiments, engages a receiver, such as a receiving device within the shower head apparatus 104, for security and handshaking protocol. The transmission module 204, in one embodiment, sends a pattern, message, etc. once communication is established with a receiving device. In a further embodiment, for each time the sensor module 202 determines that a shower item is removed, the transmission module 204 sends the message or pattern a single time after communication is established.

The transmission module 204 may use a specific protocol, such as a radio frequency identifier ("RFID") protocol, a Bluetooth® protocol, a Wi-Fi protocol, or other wireless transmission standard. The transmission module 204 may use infrared technology, radio communication, or other near field communication technology. The transmission module 204 may use any communication method that is wireless in nature and does not require transmission to a receiving device over a wire, optical fiber, or other similar physically connected medium. Where the transmission module 204 communicates using RFID, another device or module may transmit a request and the transmission module 204 may transmit an RFID signal consistent with an RFID tag. The sensor module 202 may block the transmission module 204 from sending the RFID signal until the sensor module 202 detects a shower item being removed from the shelf 106. One of skill in the art will recognize other wireless technologies suitable for use by the transmission module 204.

In one embodiment, the sensor module 202 and transmission module 204 are powered by a low voltage source. The low voltage source, in one embodiment, includes one or more batteries. In another embodiment, the low voltage source includes a transformer that reduces line voltage to a low voltage with wiring to the modules 202, 204. In another embodiment, the low voltage source includes waveforms transmitted wirelessly, for example from the shower head apparatus 104. In one example, the sensor module 202 and transmission module 204 are integrated with the shelf 106. In another embodiment, the sensor module 202 and transmission module 204 are integrated together in a unit that connects to the shelf 106 or is mounted near the shelf 106. For example, the sensor module 202 and transmission module 204 may be integrated with a sensor 108 and mounted on a wall above the shelf 106. One of skill in the art will recognize other ways to safely power the sensor module 202 and transmission module 204 and to mount the sensor module 202 and transmission module 204 in a way to be able to sense movement of a shower item.

In one embodiment, the shower apparatus 200 includes a flow reduction module 206 that reduces water flow to the shower head 116 in the shower from a first flow level to a reduced flow level in response to wirelessly receiving the item missing signal. The flow reduction module 206 may include a valve near the shower head 116 that reduces flow to the shower head 116. In another embodiment, the flow reduction module 206 reduces flow to the shower head 116 by way of one or more valves used to turn on water in the shower. The valve may be electronically actuated using a motor, solenoid, or the like. The valve may be powered by a low voltage source, such as a battery, low voltage transformer, or other power source suitable for use in a shower. In various embodiments, the low voltage source may be one or more of a piezoelectric device, a device that generates electricity from a temperature differential, a device that generates electricity from a pressure differential, a generator turned by water flow, or any other electrical source capable of generating a low voltage of sufficient power to move a valve or solenoid.

The first flow level, in one embodiment, is a flow level established by a user for showering or by valves used to supply water to the shower head 116. In another embodiment, the first flow level is set by the flow reduction module 206 or other device that is part of the shower head apparatus 104. In one embodiment, the reduced flow level is a flow level of substantially no water flow through the shower head 116, for example an "off" position. In another embodiment, the reduced flow level is a flow level below the first flow level and greater than no water flow to the shower head 116. The reduced flow level, in one example, is chosen to conserve water while a user is using a shower item initially on the shelf 106. For example, a user may pick up soap 112 and may use the soap 112 for washing. During this time, having a reduced flow level of water through the shower head 116 may be desirable to conserve water and may be beneficial while the user is applying soap 112 so that soap 112 is not washed away while lathering.

In one embodiment, the shower apparatus 200 includes a flow return module 208 that returns water flow to the first flow level in response to expiration of a restore time delay and/or wirelessly receiving an item return signal from the transmission module 204 in response to the sensor module 202 sensing a presence of the shower item on the shelf. In one configuration, the flow return module 208 returns water flow to the first flow level only after expiration of the restore time delay. The restore time delay is typically a fixed amount of time that may be preset or set by a user. In another configuration, the flow return module 208 returns water flow to the first flow level only after receiving an item return signal from the transmission module 204.

In another configuration, the flow return module 208 returns water flow to the first flow level after expiration of the restore time delay or receiving an item return signal from the transmission module 204, whichever occurs first. In another configuration, the flow return module 208 returns water flow to the first flow level after expiration of the restore time delay or receiving an item return signal from the transmission module 204, whichever occurs last. In yet another configuration, the flow return module 208 returns water flow to the first flow level after receiving an item return signal from the transmission module 204 and then expiration of the restore time delay which starts after receiving the item return signal. One of skill in the art will recognize other ways that the flow return module 208 may return water flow to the first level.

In one embodiment, the flow return module 208 returns water flow to the first flow level using the valve used by the flow reduction module 206 to reduce flow and may be powered from the same source as the flow reduction module 206. In one embodiment, all or part of the flow reduction module 206 and the flow return module 208 are part of the flow control module 114. The flow control module 114, in one embodiment, is integrated with the shower head 116. In another embodiment, the flow control module 114 is mounted between the shower head 116 and the pipe 118. In another embodiment, the flow control module 114 is mounted on the wall 120 by the shower head 116 and controls a valve in the shower head 116, the pipe 118, or other flow control valve. One of skill in the art will recognize other ways to mount the flow control module 114, valve, and other components integral with the shower head apparatus 104.

Figure 3:
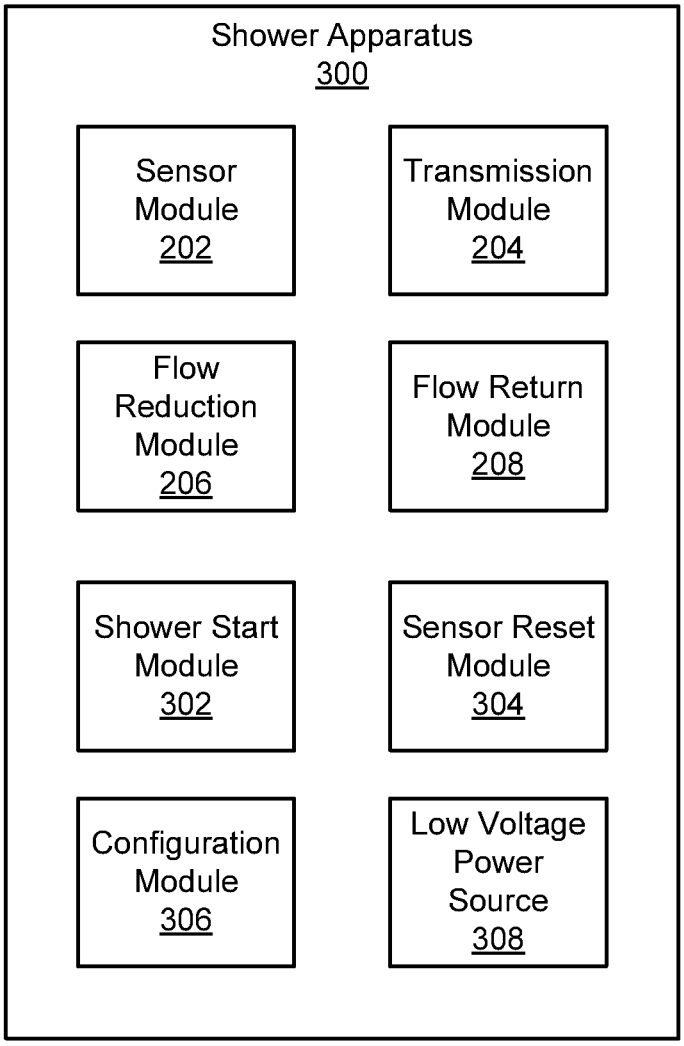
FIG. 3 is a schematic block diagram illustrating another embodiment of an apparatus for reducing water flow in accordance with the present invention.

FIG. 3 is a schematic block diagram illustrating another embodiment of a shower apparatus 300 for reducing water flow in accordance with the present invention. The shower apparatus 300 includes a sensor module 202, a transmission module 204, a flow reduction module 206, and a flow return module 208, which are substantially similar to those described above in relation to the shower apparatus 200 of FIG. 2. In various embodiments, the shower apparatus 300 may also include a shower start module 302, a sensor reset module 304, a configuration module 306, and a low voltage power source 308, which are described below.

In one embodiment, the shower apparatus 300 includes a shower start module 302 that determines that water is flowing through the shower head 116 and/or movement is detected in the shower. The apparatus 300 includes a shower reset module 304 that initiates sensing by the sensing module 202 in response to the shower start module 302 determining that water is flowing through the shower head 116 and/or that movement is detected in the shower. The shower start module 302 and sensor reset module 304 may be used to prevent continuous sensing by the sensor module 202 and thus conserve energy or battery power.

The shower start module 302 may determine that water is flowing through the shower head 116 using a flow detector, a pressure sensor, a temperature sensor, a sensor that determines that a valve is turned, or other device useful in determining that water is flowing through the shower head 116. In another embodiment, shower start module 302 determines that a user is in the shower by way of a button pushed by the user when in the shower. In one embodiment, the shower start module 302 is in the shelf apparatus 102 and senses that water is flowing through the shower head 116 by sensing increased moisture, a shower sound, movement of water or the user, or any other means to determine that water is flowing in the shower head 116, water will begin flowing soon, or the like. In another embodiment, the shower start module 302 uses a motion detector to detect movement in the shower. The motion detector may detect motion of a user, motion of water flowing, motion of a shower door opening, or the like. The motion detector may be an infrared detector, an ultrasonic detector, a combination detector, or the like. One of skill in the art will recognize other ways that the shower start module 302 may determine that water is flowing in the shower head 116 or that water could be flowing soon or that there is motion in the shower.

The sensor reset module 304, in one embodiment, receives a signal from the shower start module 302 once the shower start module 302 determines water flow in the shower head 116. In one embodiment, the sensor reset module 304 is in the shower head apparatus 104 and transmits a command, message, etc. to the shelf apparatus 102 and the sensor module 202 starts sensing after the shelf apparatus 102 receives the command, message, etc. In another embodiment, the sensor reset module 304 is in the shelf apparatus 102 and receives a signal wirelessly from a shower start module 302 in the shower head apparatus 104. In another embodiment, the shower start module 302 and sensor reset module 304 are collocated in the shelf apparatus 102 and communicate by wire, bus, etc.

In one embodiment, the shower apparatus 300 includes a configuration module 306 that allows a user to set the restore time delay and other configurable settings within the shelf apparatus 102 and shower head apparatus 104. For example, the configuration module may allow the user to configure the flow return module 208 to return water flow to the first level after the restore time delay or to configure the flow return module 208 to return water flow to the first level after receiving the item return signal, or to configure the flow return module 208 to return water flow to the first level after receiving the item return signal and the restore time delay. The configuration module 306 may allow a user to set sensitivity of the sensor 108, type of wireless communication, motion sensor sensitivity, and the like. One of skill in the art will recognize other ways that the configuration module 306 can be used to configure settings for the shelf apparatus 102 and/or the shower head apparatus 104.

The shower apparatus 300 includes a low voltage power source 308 that may be used to power the modules 202-208, 302-306 of the shower apparatus 300. The low voltage power source 308 may be two or more power sources is substantially similar to the low voltage power sources described above in relation to FIGS. 1-3.

Figure 4:
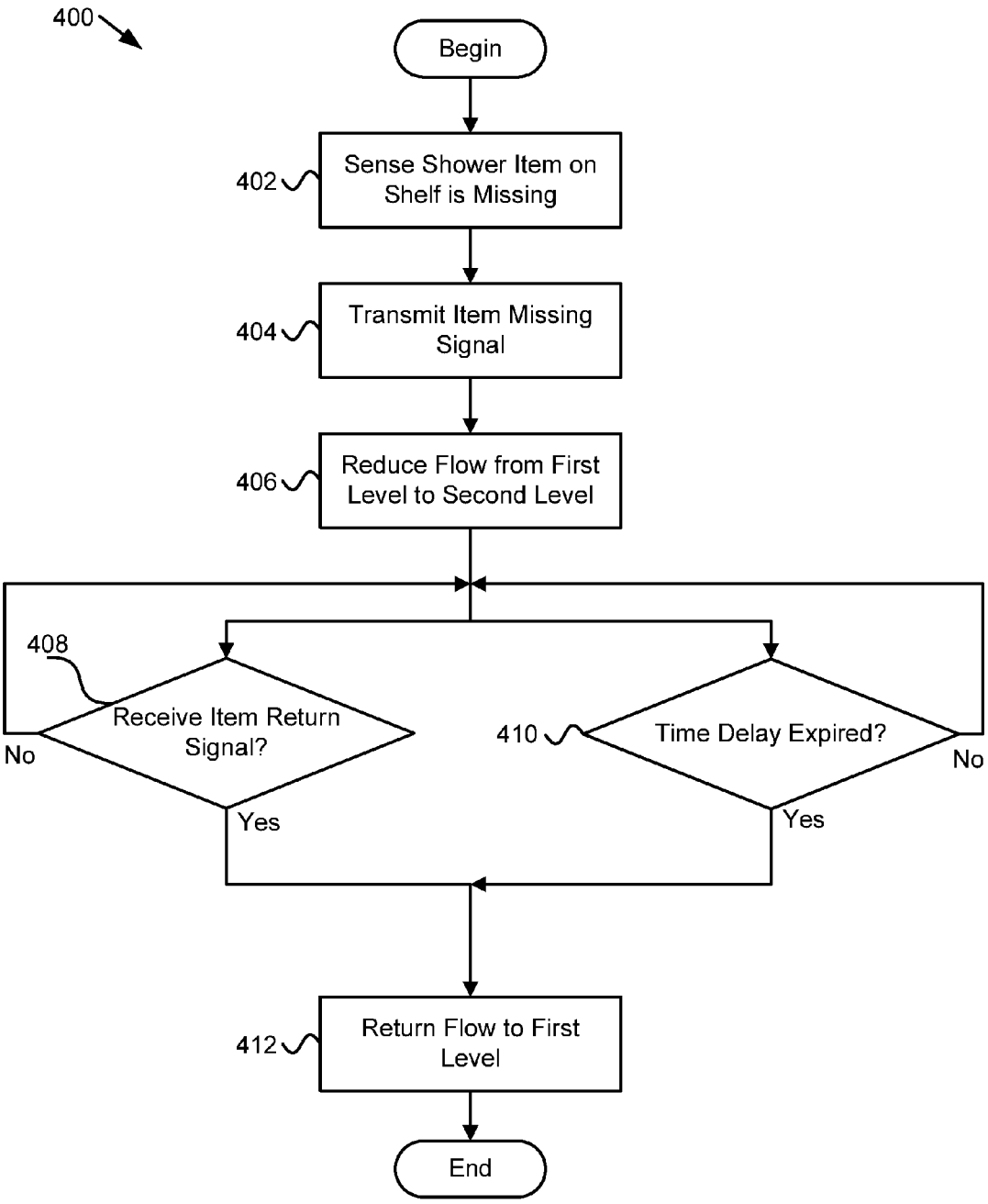
FIG. 4 is a schematic flow chart diagram illustrating one embodiment of a method for reducing water flow in accordance with the present invention.

FIG. 4 is a schematic flow chart diagram illustrating one embodiment of a method 400 for reducing water flow in accordance with the present invention. The method 400 begins and senses 402 presence of a shower item on a shelf 106 and senses a lack of presence of the shower item on the shelf 106. In one embodiment, the sensor module 202 senses 402 the shower item using a sensor 108. The shower item may be soap 112, shampoo 110, conditioner, body wash, or other item that may need to be applied to the body of a user during a shower where reduction of water flow is acceptable.

The method 400 transmits 404 an item missing signal in response to sensing 402 that a shower item is removed from the shelf 106. In one embodiment, the transmission module 204 transmits 404 the item missing signal after the sensing module 202 determines that a shower item has been removed from the shelf 106. The method 400 reduces 406 flow from a first flow level to a reduced flow level in response to the item missing signal. For example, the flow reduction module 206 may reduce 406 flow in response to receiving the item missing signal sent by the transmission module 204.

In one embodiment, the method 400 determines 408 if there an item return signal. If the method 400 determines 408 that there is an item return signal, the method 400 returns 412 flow to the first flow level and the method 400 ends. In another embodiment, the method 400 determines 410 if a restore time delay has expired. If the method 400 determines 410 that a restore time delay has expired, the method 400 returns 412 flow to the first flow level and the method 400 ends. If the method 400 determines 408 that there is no item return signal or if the method 400 determines 410 that the restore time delay has not expired, the method 400 returns and continues to determine 408 if there is an item return signal and/or to determine 410 if the restore time delay has expired. In one embodiment, the flow return module 208 determines 408 if there is an item return signal and/or determines 410 if the restore time delay has expired and also returns 412 water flow to the first flow level. One of skill in the art will recognize other configurations of determining 408 if there is an item return signal and determining 410 if a restore time delay has expired.

Figure 5:
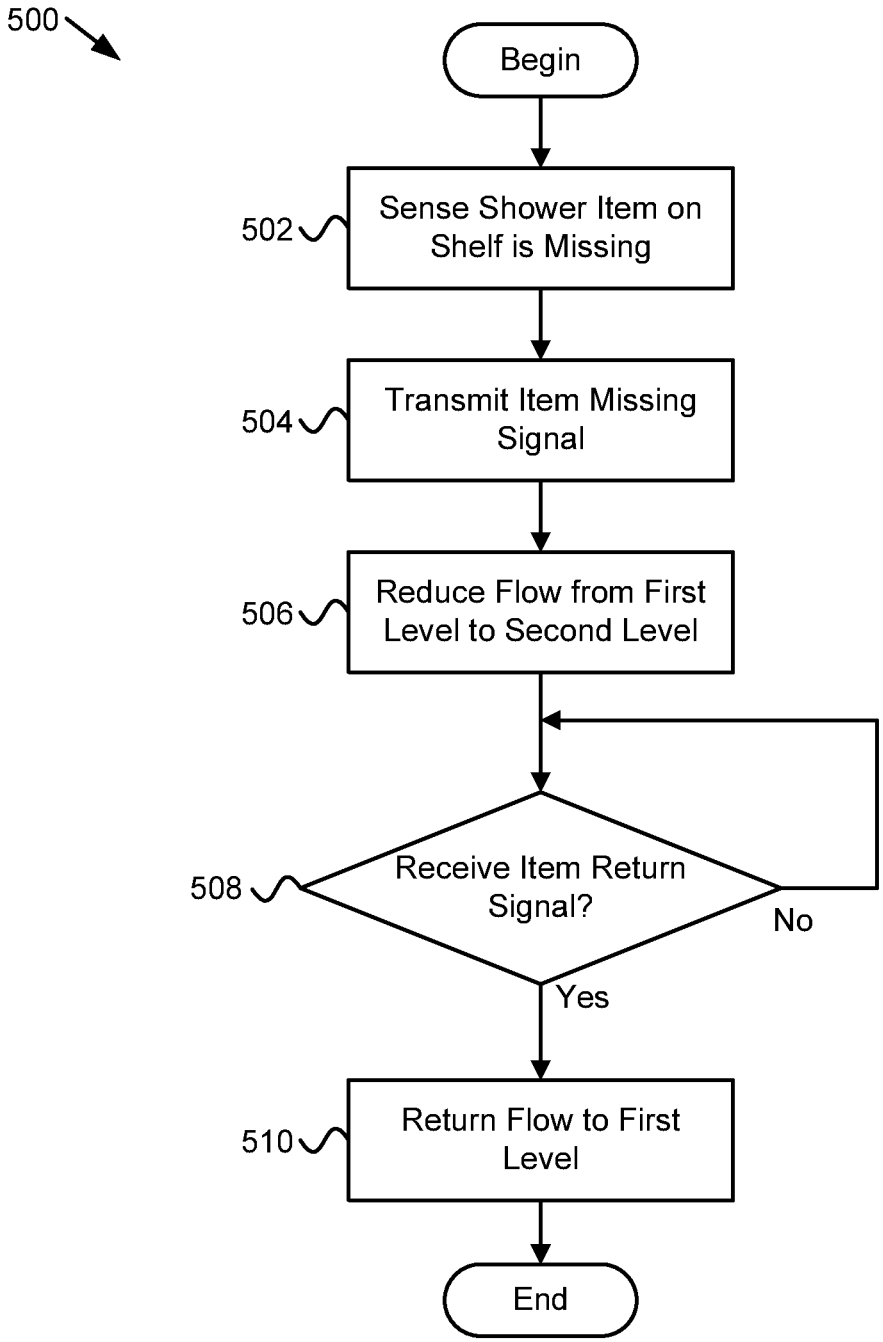
FIG. 5 is a schematic flow chart diagram illustrating an alternate embodiment of a method for reducing water flow in accordance with the present invention.

FIG. 5 is a schematic flow chart diagram illustrating an alternate embodiment of a method 500 for reducing water flow in accordance with the present invention. The method 500 depicts an embodiment where water flow is returned to a first flow level after receiving an item return signal. The method 500 begins and senses 502 presence of a shower item on a shelf 106 and senses a lack of presence of the shower item on the shelf 106. In one embodiment, the sensor module 202 senses 502 the shower item using a sensor 108. The shower item may be soap 112, shampoo 110, conditioner, body wash, or other item that may need to be applied to the body of a user during a shower where reduction of water flow is acceptable.

The method 500 transmits 504 an item missing signal in response to sensing 502 that a shower item is removed from the shelf 106. In one embodiment, the transmission module 204 transmits 504 the item missing signal after the sensing module 202 senses 502 that a shower item has been removed from the shelf 106. The method 500 reduces 506 flow from a first flow level to a reduced flow level in response to the item missing signal. For example, the flow reduction module 206 may reduce 506 flow in response to receiving the item missing signal sent by the transmission module 204.

The method 500 determines 508 if there an item return signal. If the method 500 determines 508 that there is an item return signal, the method 500 returns 510 flow to the first flow level and the method 500 ends. If the method 500 determines 508 that there is no item return signal, the method 500 continues to determine 508 if there is an item return signal. The flow return module 208, in one embodiment, may be configured to check for an item return signal without determining if a restore time delay has expired.

Figure 6:
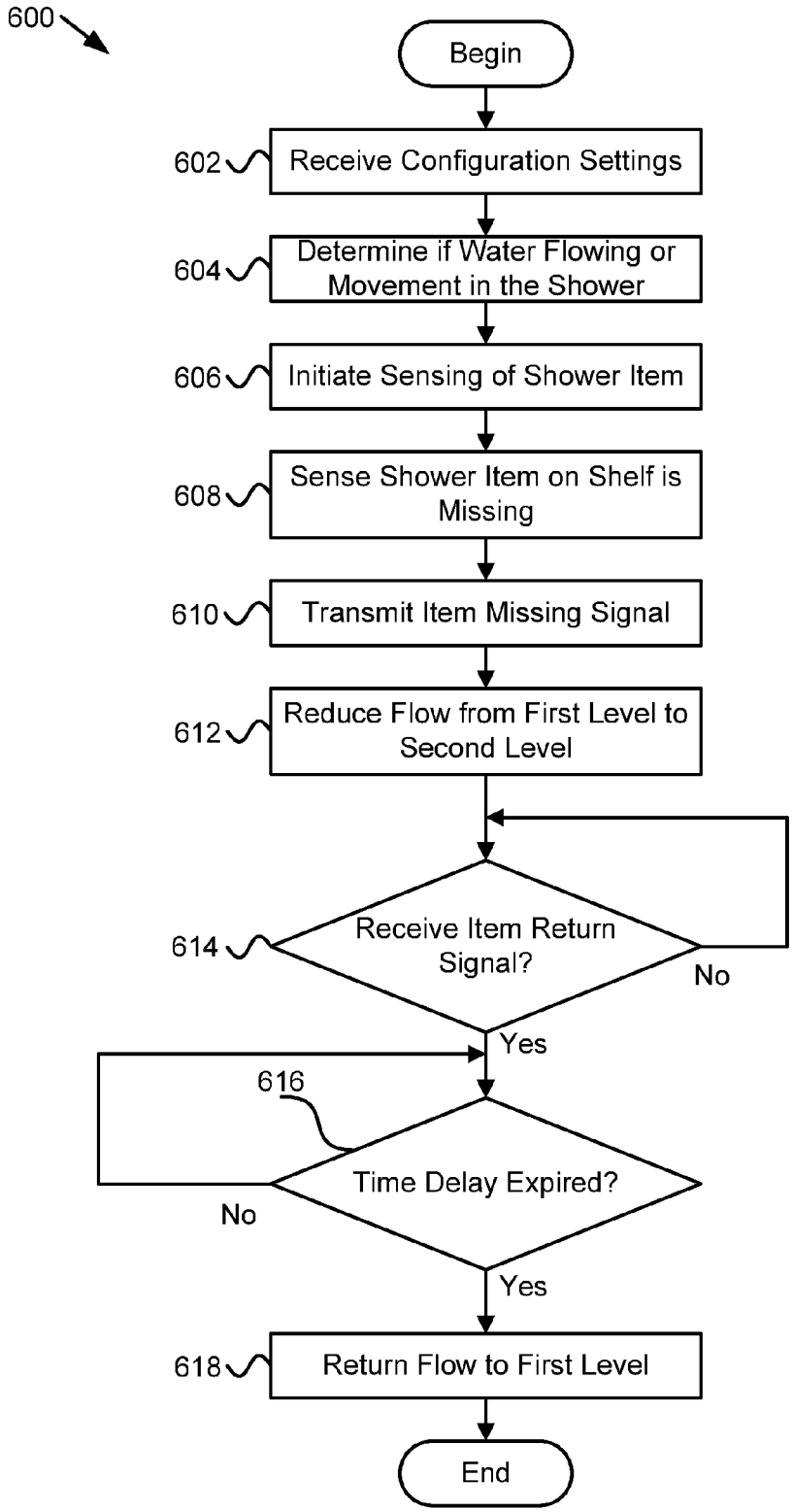
FIG. 6 is a schematic flow chart diagram illustrating another embodiment of a method for reducing water flow in accordance with the present invention.

FIG. 6 is a schematic flow chart diagram illustrating another embodiment of a method 600 for reducing water flow in accordance with the present invention. The method 600 begins and receives 602 configuration settings. The configuration settings, in one embodiment, are received from a user. In another embodiment, the configuration module 306 may be used to receive 602 configuration settings.

The method 600 determines 604 if water is flowing through the shower head 116 or if there is movement in the shower. In one embodiment, the shower start module 302 determines if water is flowing through the shower head 116 or if there is movement in the shower. The method 600 initiates 606 sensing of the shower items on the shelf 106 in response to determining 604 that water is flowing through the shower head 116 or if there is movement in the shower. In one embodiment, the sensor reset module 304 initiates 606 sensing by the sensing module 202.

The method 600 senses 608 presence of a shower item on a shelf 106 and senses a lack of presence of the shower item on the shelf 106. The shower item may be soap 112, shampoo 110, conditioner, body wash, etc. The method 600 transmits 610 an item missing signal in response to sensing 608 that a shower item is removed from the shelf 106. In one embodiment, the transmission module 204 transmits 610 the item missing signal after the sensing module 202 senses 608 that a shower item has been removed from the shelf 106. The method 600 reduces 612 flow from a first flow level to a reduced flow level in response to the item missing signal. For example, the flow reduction module 206 may reduce 612 flow in response to receiving the item missing signal sent by the transmission module 204.

The method 600 determines 614 if there is an item return signal. If the method 600 determines 614 that there is no an item return signal, the method 600 returns to determine 614 if there is an item return signal. If the method 600 determines 614 that there is an item return signal, the method 600 determines 616 if a restore time delay has expired. If the method 600 determines 616 that the restore time delay has not expired, the method 600 returns and continues to determine 616 if the restore time delay has expired. If the method 600 determines 616 that the restore time delay has expired, the method 600 returns 618 the water flow through the shower head 116 to the first flow level, and the method 600 ends. In one embodiment, the flow return module 208 determines 614 if there is an item return signal, determines 616 if a restore time delay has expired, and returns 618 the water flow through the shower head 116 to the first flow level. In various embodiments, the flow return module 208 may be configured in various forms to return 618 the water flow to the first flow level using a time delay and/or an item return signal.

The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a sensor module that senses a presence of a shower item on a shelf in a shower and senses a lack of presence of the shower item on the shelf by sensing a change in weight on the shelf;

a transmission module that transmits an item missing signal, the item missing signal transmitted in response to the sensor module sensing a lack of presence of the shower item on the shelf, the item missing signal comprising a wireless signal;

a flow reduction module that reduces water flow to a shower head in the shower from a first flow level to a reduced flow level in response to wirelessly receiving the item missing signal;

a flow return module that returns water flow to the first flow level in response to one or more of expiration of a restore time delay; and wirelessly receiving an item return signal from the transmission module, the item return signal in response to the sensor module sensing a presence of the shower item on the shelf;

a configuration module that, in response to user input, changes sensitivity settings of the sensor module;

a shower start module that determines that water is flowing through the shower head; and a sensor reset module that initiates sensing by the sensing module in response to the shower start module determining that water is flowing through the shower head, wherein the transmission module withholds sending the item missing signal until after the shower start module determines that water is flowing through the shower head, the sensor reset module initiates sensing, and the sensor module senses the presence of the shower item on the shelf and then senses lack of the shower item on the shelf, wherein the sensor module and the transmission module are integral with the shelf, and wherein the flow reduction module and the flow return module are collocated with the shower head.

2. The apparatus of claim 1, wherein the item missing signal comprises one or more of a radio frequency identifier ("RFID") signal and a blue tooth signal.

3. The apparatus of claim 1, wherein the item return signal comprises cessation of the item missing signal.

4. The apparatus of claim 1, wherein the sensor module, the transmission module, flow reduction and the flow return module are powered with a low voltage power source.

5. The apparatus of claim 4, wherein the low voltage power source is a battery.

6. The apparatus of claim 1, wherein the flow reduction and the flow return module are integral with the shower head.

7. The apparatus of claim 1, wherein the sensor module and the transmission module are mounted with the shelf.

8. The apparatus of claim 1, wherein the sensor module blocks the transmission module from sending an RFID signal as the item missing signal until the sensor module detects the lack of presence of the shower item.

9. The apparatus of claim 1, wherein the sensor module senses the presence of the shower item using one or more of an infrared sensor and an ultrasonic sensor focused on an area above the shelf.

10. The apparatus of claim 1, wherein the configuration module that, in response to user input, one or more of sets the restore time delay;

configures the flow return module to return water flow to the first level after the restore time delay;

configures the flow return module to return water flow to the first level after receiving the item return signal; and configures the flow return module to return water flow to the first level after receiving the item return signal and after the restore time delay.

11. A system comprising:

a shelf apparatus configured to mount with a shelf in a shower, the shelf apparatus comprising a sensor module that senses a presence of a shower item on the shelf in a shower and senses a lack of presence of the shower item on the shelf by sensing a change in weight on the shelf;

a transmission module that transmits an item missing signal, the item missing signal transmitted in response to the sensor module sensing a lack of presence of the shower item on the shelf, the item missing signal comprising a wireless signal;

a shower head apparatus configured to mount with a shower head in the shower, the shower head apparatus comprising a flow reduction module that reduces water flow to the shower head from a first flow level to a reduced flow level in response to wirelessly receiving the item missing signal; and a flow return module that returns water flow to the first flow level in response to one or more of expiration of a restore time delay and wirelessly receiving an item return signal from the transmission module, the item return signal in response to the sensor module sensing a presence of the shower item on the shelf;

a configuration module that, in response to user input, changes sensitivity settings of the sensor module;

a shower start module that determines that water is flowing through the shower head; and a sensor reset module that initiates sensing by the sensing module in response to the shower start module determining that water is flowing through the shower head, wherein the transmission module withholds sending the item missing signal until after the shower start module determines that water is flowing through the shower head, the sensor reset module initiates sensing, and the sensor module senses the presence of the shower item on the shelf and then senses lack of the shower item on the shelf, wherein the sensor module and the transmission module are integral with the shelf, and wherein the flow reduction module and the flow return module are collocated with the shower head.

12. The system of claim 11, wherein the shower head apparatus is integral to the shower head.

13. The system of claim 11, wherein the shower head apparatus is connected to the shower head.

14. An apparatus comprising:

a sensor module that senses a presence of a shower item on a shelf in a shower and senses a lack of presence of the shower item on the shelf by sensing a change in weight on the shelf;

a transmission module that transmits an item missing signal, the item missing signal transmitted in response to the sensor module sensing a lack of presence of the shower item on the shelf, the item missing signal comprising one or more of a radio frequency identifier ("RFID") signal and a blue tooth signal;

a flow reduction module that reduces water flow to a shower head in the shower from a first flow level to a reduced flow level in response to wirelessly receiving the item missing signal;

a flow return module that returns water flow to the first flow level in response to one or more of expiration of a restore time delay; and wirelessly receiving an item return signal from the transmission module, the item return signal in response to the sensor module sensing a presence of the shower item on the shelf;

a shower start module that determines that water is flowing through the shower head;

a sensor reset module that initiates sensing by the sensing module in response to the shower start module determining that water is flowing through the shower head; and a configuration module that, in response to user input, changes sensitivity settings of the sensor module, wherein modules at the shelf location and modules at the shower head location communicate wirelessly without wires between the shelf location and the shower head location wherein the transmission module withholds sending the item missing signal until after the shower start module determines that water is flowing through the shower head, the sensor reset module initiates sensing, and the sensor module senses the presence of the shower item on the shelf and then senses lack of the shower item on the shelf, wherein the sensor module and the transmission module are integral with the shelf, and wherein the flow reduction module and the flow return module are collocated with the shower head.

* * * * *